United States Patent [19]

Wittersheim

[11] 4,103,900

[45] Aug. 1, 1978

[54] ORIGINALITY SEAL FOR DISPOSABLE RECEPTACLES

[75] Inventor: Adam Wittersheim, Nieder-Ramstadt-Trautheim, Fed. Rep. of Germany

[73] Assignee: Goldwell GmbH Chemische Fabrik H.E. Dotter, Darmstadt-Eberstadt, Fed. Rep. of Germany

[21] Appl. No.: 718,698

[22] Filed: Aug. 30, 1976

[30] Foreign Application Priority Data

Sep. 8, 1975 [DE] Fed. Rep. of Germany ..... 2539838

[51] Int. Cl.[2] ..... B65B 7/28; B65D 41/32

[52] U.S. Cl. ..... 277/2; 215/256; 277/DIG. 10

[58] Field of Search ..... 215/250, 253, 256; 206/820; 220/375; 277/2, 237 R, DIG. 10

[56] References Cited

U.S. PATENT DOCUMENTS

| | | | |
|---|---|---|---|
| 2,985,291 | 5/1961 | Schoepe et al. | 206/820 |
| 3,407,976 | 10/1968 | Homma | 215/250 |
| 3,441,161 | 4/1969 | Van Baarn | 215/256 |
| 3,673,761 | 7/1972 | Leitz | 215/253 |
| 3,712,645 | 1/1973 | Herter | 277/2 |
| 3,913,771 | 10/1975 | Action et al. | 215/256 |
| 3,980,195 | 9/1976 | Fillmore | 215/256 |
| 3,991,904 | 11/1976 | Davis | 215/256 |
| 3,998,354 | 12/1976 | Song | 220/375 |
| 4,037,748 | 7/1977 | Stubbs | 215/256 |

*Primary Examiner*—Robert I. Smith
*Attorney, Agent, or Firm*—Allison C. Collard

[57] ABSTRACT

An originality seal for disposable or single use receptacles adapted to be fitted to an applicator having a peripheral sealing surface for connection to the disposable receptacles consisting of a receptacle-side sealing surface for engaging the wall of the disposable receptacle. The seal includes a resilient sealing ring surrounding the sealing surface, the ring having at least two sealing lips, one of the lips cooperating sealingly with the peripheral sealing surface of the applicator when the disposable receptacle is fitted thereto and the second sealing lip cooperating sealingly with the receptacle side sealing surface. There is also frangible webs coupling the resilient sealing rings to the receptacle-side sealing surface so that the frangible webs will rupture by the force of engagement of the disposable receptacle to the applicator.

8 Claims, 4 Drawing Figures

FIG. 1B
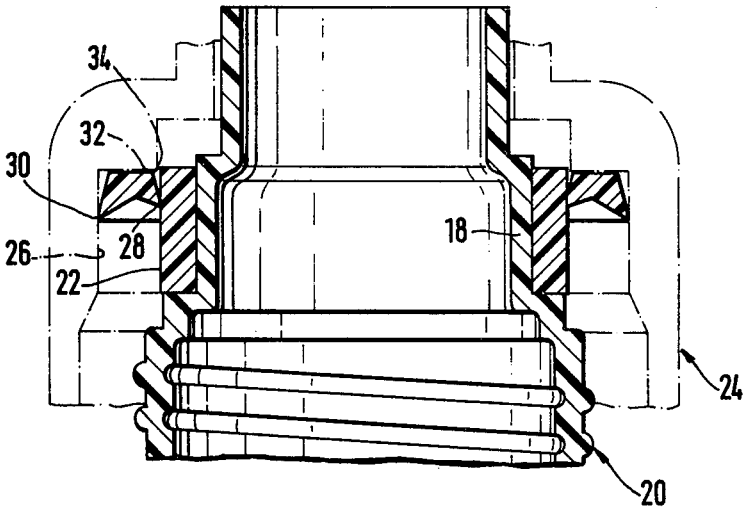
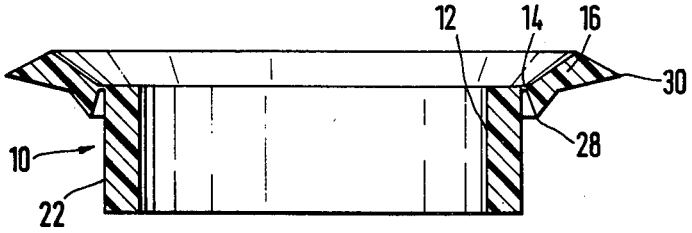
FIG. 1A

FIG. 2B
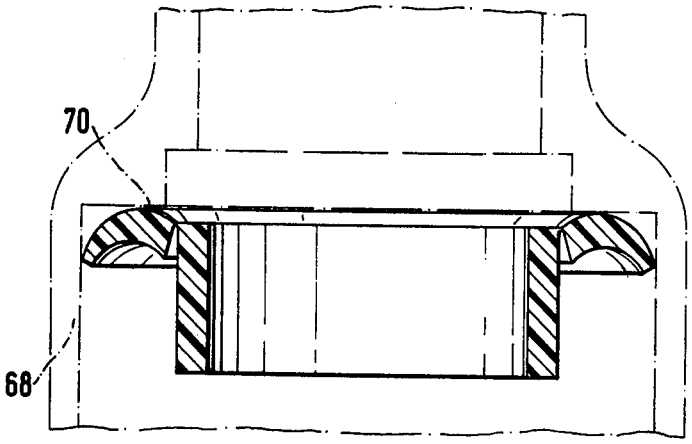
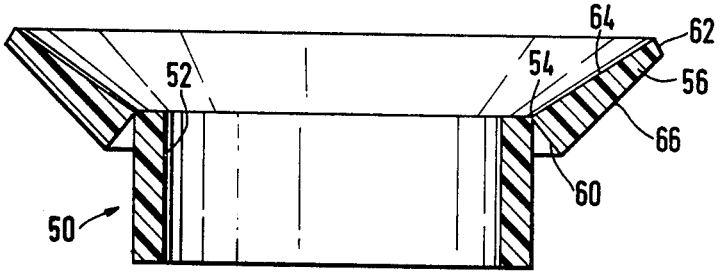
FIG. 2A

ORIGINALITY SEAL FOR DISPOSABLE RECEPTACLES

The invention relates to an originality seal for single use or disposable receptacles for connection to applicator appliances, e.g. for applying cosmetic preparations, the applicators having a peripheral sealing surface near the applicator connection for the receptacles.

Originality seals are widely used at present, in the form of pilfer-proof or tamper-proof seals, in association with the screwthreaded bottle caps. In these known originality seals, the actual screwthreaded cover of the receptacle is connected by way of frangible webs to a closure element which cannot be removed from the receptacle. The webs are ruptured at the first opening of the cover. Consequently, undamaged frangible webs are a guarantee that the receptacle contains the maker's original product. A careful purchaser can therefore make sure that he has not bought an imitation by seeing that the frangible webs are intact.

A similar but more difficult problem of originality sealing arises where the goods, are not taken away by a customer after purchase, but are in the form of preparations which are applied cosmetically or medically from applicators. As a rule, it is impossible to check on the receptacle closure in such cases, more particularly when the preparations are applied from applicators, since there is then no guarantee at all that the preparation used to fill the applicator corresponds to the preparation required by the customer. The industry has therefore decided not to use fittable refillable receptacles for applicances, but to devise preparation receptacles that can be connected directly to the applicators as portion receptacles, correct dosage of the preparation being guaranteed by an appropriate choice of the capacity of the receptacle. Unfortunately, the provision of a pilfer-proof seal for such individual portion receptacles does not make it impossible for the empty receptacle to be refilled with a lower-quality product and reused.

It is therefore an object of the invention to provide an originality seal which, in the case just described, ensures that, for treatments involving the use of cosmetic or medicinal preparations by applicators, it is possible to use only the original preparation whose quality can be checked by the patient by observation of the single use receptacle fitted to the applicator. Thus, it must be impossible for the receptacle to be refilled without the user being aware of the fact that it has been refilled.

According to the invention, the originality seal is a resilient lipped sealing ring made of plastic and having at least two sealing lips wherein one of the lips cooperates sealingly with the sealing surface of the applicator connection when the receptacle is fitted thereto. The lipped seal has, through the agency of frangible webs, a second sealing surface on the receptacle, the latter surface cooperating sealingly with the second sealing lip when the receptacle is engaged with the appliance connection. The strength of the frangible webs is such that they can be ruptured by the forces arising upon engagement with the receptacle connection. As with conventional originality seals, the fact that the sealing ring webs are undamaged is an indication that the ring is connected to an applicator for the first time. Also, a receptacle which has already been used cannot be engaged with the required sealing ring of the applicator once the frangible webs have been destroyed. No amount of manipulation can bring the ring into a correct position of sealing tight engagement with the two sealing surfaces of the applicator and the receptacle.

If a receptacle were to be used without the ruptured sealing ring, the preparation would issue not from the spraying or applicator nozzle, but from the applicator connection, since the conventional screwthreaded or bayonet connections, which at positive pressure cannot provide adequate sealing tightness without additional sealing elements, are formed with additional clearance or with additional gaps for this particular application.

Where the receptacles to be fitted to the applicator are blow-moulded plastic receptacles, the second receptacle-side sealing surface is formed on a support or carrying ring which is produced separately from the receptacle, then assembled thereto.

Preferably, the lipped sealing ring and the support or carrying ring which is integral therewith by way of the frangible webs is an integral plastic extrusion.

However, in cases in which the receptacle to be connected to the applicator is an injection moulding and the second sealing surface is contrived directly on the receptacle, the lipped sealing ring can be formed directly on the receptacle.

To ensure that the sealing lip engages the sealing surfaces with the biasing desirable for a reliable tight seal, the outer diameter of the lipped sealing ring is, conveniently, oversized relatively to the zone for receiving the ring in the appliance connection, so that when the receptacle is fitted to the appliance connection, the lipped sealing ring distorts resiliently and the sealing lips are therefore biased into engagement with the associated sealing surface because of the distortion forces. If the oversize is appropriately dimensioned, the force required to distort the sealing ring can be used to also to rupture the frangible webs. Alternatively, however, the appliance connection can comprise an internal step or shoulder which comes into abutting engagement when the receptacle is fitted to the sealing ring and which serves to rupture the frangible webs.

As a rule, the sealing surface in the applicator connection is internally cylindrical whereas the sealing surface on the receptacle is cylindrical. In the case, the sealing ring is preferably devised so as to have two sealing lips which in cross-section converge towards one another at an acute angle. The lip which is associated with the receptacle sealing surface extends rearwardly and oppositely to the application direction, and the sealing lip associated with the sealing surface in the applicator connection extends substantially radially but also slightly rearwardly and inclinedly. Consequently, the sealing lips offer reduced resistance to the introduction of the receptacle into the applicator connection but increased resistance to removal of the applicator after consumption of the receptacle filling. An advantage of the lips being inclined rearwardly is that the sealing lips do not suffer damage even when they pass over relatively small unevennesses, but yield resiliently. However, when the receptacle is removed from the applicator, the unevennesses causes damage to the lips, a desirable feature in the light of the problem which it is the aim of the present invention.

As an alternative, the sealing ring can have a cross-section in the form of an elongated slender quadrilateral having two relatively short end sides and two connecting sides longer by several times than the short sides, the end side which is associated with the receptacle sealing surface being longer than the end side associated with the sealing surface in the applicator connection, the connecting sides extending not purely radially from the receptacle but inclinedly forwards in the engagement direction.

Other objects and features of the present invention will become apparent from the following detailed description when taken in connection with the accompanying drawings which disclose several embodiments of the invention. It is to be understood that the drawings are designed for the purposes of illustration only, and are not intended as a definition of the limits and scope of the invention disclosed.

In the drawings, wherein similar reference numerals denote similar elements throughout the several views:

FIG. 1A is a section through a first embodiment of an originality seal according to the invention;

FIG. 1B is a section through the originality seal shown in FIG. 1A when it is secured to a receptacle, in the position in which the seal has been deformed by the connection of an applicator;

FIG. 2A is a cross-sectional view corresponding to FIG. 1A showing a second embodiment of an originality seal according to the invention; and FIG. 2B is a view, corresponding to FIG. 1B, of the embodiment of FIG. 2A, the receptacle not being shown for the purpose of simplicity.

Referring to FIGS. 1A and 1B, there is shown an originality seal 10 according to the invention basically consisting of two main items — a support or carrying ring 12 and a sealing ring 16 secured to the top end thereof by way of a number of peripherally distributed frangible webs 14. Seal 10 is an integral plastic extrusion or injection moulding. Ring 12 can be disposed on an appropriately devised spigot 18 of a receptacle 20 and secured thereto either by a tight fit or by sticking. The cylindrical outside surface of ring 12 forms a receptacle-side sealing surface 22, a second and internally cylindrically sealing surface 26 being provided in applicator connection 24, the latter being illustrated only in diagrammatic form in broken lines.

Sealing ring 16 has two sealing lips 28 and 30 which terminate in acute-angled sealing edges. Inner lip 28 is associated with the receptacle-side sealing surface 22, and extends downwardly when in the undistorted initial position shown, at a reduced distance from the sealing surface. Lip 30 extends substantially radially outwardly and when in its initial position, it is a larger diameter than the associated sealing surface 26 in applicator connection 24. Consequently, when receptacle spigot 18 is introduced into connection 24, sealing ring 16 deforms in the manner shown in FIG. 1B. Outer sealing lip 30 is compressed inclinedly and downwardly, the relatively small force for such compression possibly being used to rupture frangible webs 14. To ensure that webs 14 actually rupture, the applicator connection can comprise a step or shoulder 32 which, with the receptacle in its final securing position on the applicator, is disposed below webs 14 and has at its inside edge 34 a diameter which is only slightly larger than the outside diameter of support ring 12. In this case, webs 14 rupture automatically, irrespective of the distorting force of sealing rings 16.

The resilient compression of ring 16 forces inner lip 28 into engagement with sealing surface 22, so that hermetic sealing-tightness is ensured both at the sealing surface of the applicator connection, and at the receptacle sealing surface.

When receptacle 20 is disconnected from the applicator after emptying, sealing ring 16, which is no longer connected to support or carrying ring 12, drops; no amount of manipulation can restore sealing ring 16 to the proper sealing position between the surfaces 22 and 26 when the receptacle is reengaged with the applicator connection. The receptacle cannot therefore be refilled and reused without at least some of the refill issuing at the applicator connection and thus revealing that the filling is not the original one.

The embodiment shown in FIGS. 2A and 2B of an originality seal 50 corresponds to the seal previously described except that sealing ring 56, which is connected to support on carrying ring 52 by way of frangible webs 54, is different. Ring 56 has, when undistorted (FIG. 2A), the cross-sectional shape of a narrow elongated quadrilateral comprising two relatively short terminal sides 60 and 62 and two connecting sides 64 and 66 which are several times as long as sides 60 and 62. Terminal side 60, associated with the sealing surface on the outside of ring 52, is longer than the terminal side 62 extending towards the sealing surface of applicator connection 68. The peripheral annular surfaces formed by connecting sides 64 and 66 as generatrices widen funnel-fashion or conically from support ring 52 in the fitting or engagement direction. When introduced into applicator connection 68, the forwardly directed outer periphery of ring 56 is pressed against a shoulder or step 70 formed in connection 68, and ring 56 is bent outwardly in the manner shown in FIG. 2B. As the receptacle enters further into connection 68, the inside of step or shoulder 70 ruptures the frangible webs connected to support or carrying ring 52. The peripheral sealing-ring edges, which act as sealing lips, are pressed tightly on to the associated sealing surfaces of the support ring 52 or applicator connection 68, so that the required hermetic connection is provided between the receptacle and the applicator connection. Since in other respects the operation of originality seal 50 corresponds to the seal of FIG. 1, reference can be made to the latter description in order to avoid repetition.

As will be apparent, variations and developments within the scope of the underlying idea of the invention are possible with regard to the exact shape of the sealing rings and the arrangement of the sealing lips. The support or carrying ring can be omitted if the receptacle is an injection moulding in which a sealing ring is mounted integrally with the receptacle. In this event, of course, a sealing surface corresponding to the sealing surface on the outer periphery of the support or carrying ring must be provided on the receptacle.

What is claimed is:

1. An originality seal for a disposable, non-reusable receptacle having a spout receivable within an opening of an applicator, which applicator has a wall extending peripherally about, and outwardly from the opening therein, comprising:

sealing means associated with said spout of said receptacle, said sealing means including a peripheral wall sealing surface disposable about said spout which opposes and is spaced from the interior peripheral surface of said applicator wall when said spout is received in said opening of said applicator;

a resilient sealing ring receivable on said spout adjacent to said peripheral sealing surface associated therewith, said ring having at least two sealing lips, one of which is disposed for cooperative sealing engagement with the interior peripheral surface of the wall of the applicator and the other of which is disposed for cooperative sealing engagement with said sealing surface associated with said spout of said receptacle when said spout is received within said opening; and frangible web means coupling said resilient sealing ring to said sealing surface associated with said receptacle spout which ruptures upon receipt of said spout within the opening of said applicator to prevent reuse of said sealing ring and, in turn, said originality seal.

2. The originality seal according to claim 1 wherein said sealing means comprises a substantially cylindrical carrying ring mountable on the spout of the receptacle, the outer circumferential surface of which defines said peripheral sealing surface.

3. An originality seal according to claim 2, wherein said sealing ring has a cross-sectional shape of an elongated slender quadrilateral having two relatively short terminal sides and two longer connecting sides, said longer connecting sides being several times longer than said short terminal sides, one of said terminal sides being associated with said receptacle-sealing surface and being longer than said other terminal side, said other terminal side being associated with said applicator sealing surface, said connecting sides extending substantially outwardly but displaced from a radial extent from the receptacle and inclined forwardly in the engagement direction.

4. The originality seal according to claim 2 wherein said sealing ring, carrying ring and frangible means are a unitary integral plastic structure fabricated by plastic extrusion techniques.

5. The originality seal according to claim 2 wherein said sealing lips each have an acute-angled cross-section, said one sealing lip extending substantially radially outwardly from said ring and being inclined rearwardly relative to the direction of receptacle movement to effect receipt of the spout thereof into said applicator opening and said other sealing lip extending rearwardly and oppositely relative to said receptacle movement direction.

6. The originality seal according to claim 1 wherein said sealing means and said frangible web means are a unitary integral plastic structure and are integrally formed on said receptacle spout.

7. The originality sealer according to claim 1 wherein the outer diameter of said sealing ring is slightly larger than the diameter defined by the inner peripheral surface of the wall of the applicator so that said sealing ring will be resiliently deformed when said receptacle spout is inserted into the opening of said spout and said resilient sealing lips thereof will be in biased engagement with their respective peripheral wall surfaces.

8. The originality seal according to claim 1 wherein said applicator has a peripheral, radially inwardly extending annular step formed at the base of the wall thereof, the diameter of the inside edge of which is at least equal to the outer diameter of the said sealing ring, said sealing ring being disposed on said spout of said receptacle such that the receptacle is engaged with the step after travelling only part of the distance necessary to effect full receipt therein of the spout thereof in said applicator opening, so that, in turn, during the remainder of the movement thereof to complete full receipt therein, said frangible webs will be positively ruptured by said step.

* * * * *